United States Patent [19]

D'Amiano

[11] 3,965,685

[45] June 29, 1976

[54] METHOD FOR LOWERING GROUND WATER

[76] Inventor: Anthony J. D'Amiano, 5881 SW. 8th St., Plantation, Fla. 33314

[22] Filed: Sept. 25, 1974

[21] Appl. No.: 509,241

[52] U.S. Cl. ..... 61/11; 175/314

[51] Int. Cl.[2] ..... E02B 11/00

[58] Field of Search ..... 61/11, 12, 63; 166/235, 166/236; 175/314

[56] References Cited

UNITED STATES PATENTS

| | | | |
|---|---|---|---|
| 1,570,697 | 1/1926 | Moore | 61/11 |
| 3,441,140 | 4/1969 | Thurber | 61/11 |
| 3,522,708 | 8/1970 | Firman | 61/11 |
| 3,797,251 | 3/1974 | Shimizu | 61/11 |

FOREIGN PATENTS OR APPLICATIONS

| | | | |
|---|---|---|---|
| 1,441,740 | 5/1966 | France | 61/11 |
| 1,484,369 | 3/1969 | Germany | 61/11 |
| 478,962 | 9/1969 | Switzerland | 61/11 |
| 1,147,610 | 4/1969 | United Kingdom | 61/11 |

*Primary Examiner*—Paul R. Gilliam
*Assistant Examiner*—Alex Grosz
*Attorney, Agent, or Firm*—Lerner, David, Littenberg & Samuel

[57] ABSTRACT

A pre-packed well point is provided having a central tube perforated only at the bottom end thereof. Coaxial with the inner tube is an outer screen and the inner and outer tubes are joined by suitable top and bottom end caps. Packed between the outer screen and the inner tube is a mass of particulate matter, such as gravel. The pre-packed well point is inserted in the ground into position by vertically augering into the ground utilizing a hollow auger whose inner diameter is slightly larger than the outer diameter of the pre-packed well point. The bottom of the hollow auger is a separable bit. The hollow auger is driven into place by a portable drive mechanism mounted on a vehicle. When the hollow auger is driven, it drills a hole into the ground, with the spiral channels removing the dirt from the hole as it is being formed. When the auger reaches the desired depth, it is raised a short distance from the bottom of the hole. Then, the pre-packed well point is dropped through the hollow center of the auger. When the pre-packed well point hits the separable bit, it opens the bottom of the auger and the pre-packed well point falls to the bottom of the hole. Thence the auger is rotated and pulled out of the hole. As it is so rotated, the dirt in the spiral channels of the auger and the hole packs around the outside of the pre-packed well point which remains in place. After the hollow auger is totally removed, vacuum is applied to the inner tube of the pre-packed well point to pump water through the bottom perforations which draws water from the water tables, through the outer screen, and thence downwardly through the gravel into the inner tube in the same manner as prior art well points.

2 Claims, 14 Drawing Figures

112
87
114
124
122
116
118
120

112
87
114
116
124
130
126
132
134
118
122
120

112'
87'
114'
136
122'
126'
142
116'
120'
122''
124''
116''
142''
138
142'
120''
124'''
142'''
126'''
116'''
122'''
118'''
140
120'''

METHOD FOR LOWERING GROUND WATER

BACKGROUND OF THE INVENTION

In the past, well pointing has been achieved by a rather painstaking and labor involving method. This included forcing a well point tube having perforations at the bottom thereof into the ground using high pressure water to force dirt away from and form a hole as the well point is forced deeper into the earth. Then, after the required depth is reached, the pressure is reduced to a slow boil and sand is hand shoveled about the outside of the tube. The sand, being heavier than the water, falls about the tube packing the sides thereof. Then the tube is connected to a source of vacuum by a coupling means. The packing of the sand around the tube required hand labor and many times there were gaps left because the packing was not uniformly achieved around the tube by means of the hand operation. Further, this was very expensive because, after a job was completed, the well point tube could be removed, but the sand would remain in the ground. With the cost of sand, this is an extremely expensive process. Further, the labor costs for inserting the well points was considerable and added considerably to the expense of this method of lowering water tables. For example, a well pointing crew of five to seven men could only insert thirty twenty foot well points in a day. Additionally, this method required a source of high pressure water at the site of the well pointing operation.

SUMMARY OF THE INVENTION

In order to eliminate the need to waste expensive sand, to avoid the needless labor associated with packing the sand around the well point tube and the need for a high pressure source of water at the side, a modular well point has been developed comprising an inner well point tube, having perforations at the bottom end thereof, and surrounded by a coaxial screen. Between the screen and the inner tube, there is placed particulate matter, such as gravel, and the bottom end is sealed. An annular top plate is used to seal the space around the top end of the inner tube and the screen and to seal in the gravel. The upper end of the inner tube is adapted to be coupled to a vacuum pump which pumps the water in the water table surrounding the well point down through the screen, and through the gravel, into the perforations at the bottom of the inner tube, and thence upwardly out the center of the tube. The pre-packed well point, after installation can be removed and reused, avoiding the need for new gravel. The pre-packed modular well point can be made in predetermined lengths and connected together, modularly, to form a well point of any desired length. Alternatively, a pre-packed well point can be attached to a tube of a desired length so that only the last few feet of the hole has the pre-packed well point.

The pre-packed well point is inserted into the ground by utilizing a hollow auger portably mounted on a vehicle. The portable auger is mounted for vertical positioning and has a central hollow shaft. The bottom of the auger has a retractable bit which stays in place while drilling, and which will open when the well point is dropped through the central hollow shaft and strikes the bit from the inside surface thereof.

In operation, the portable hollow auger is positioned vertically over the area to be drilled, the auger is then rotated and moved downwardly. Dirt is forced upwardly around the spiral channel about the auger as the bit cuts into the ground. When the auger reaches the desired depth, it is rotated to draw it upwardly a short distance, for example, 1 foot. Then, the pre-packed well point is dropped through the central shaft of the auger until it strikes the inner surface of the separable bit causing the bit to open and allow the well point to drop to the bottom of the drilled hole. Thence the auger is continued to be rotated in order to retract it from the hole. As it retracts, the dirt in the spiral channels and the dirt around the hole move downwardly about the surface of the well point to hold it in place. After the auger is removed, the well point is in the ground with the inner tube or an extension thereof extending above the surface to be coupled to a vacuum pump. When vacuum is applied, the dirt around the well point is drawn against the outer screen surface and the water in the water table is drawn through the ground and the screen into the gravel, and thence downwardly to the perforations at the bottom of the inner tube. The water is then drawn through those lowermost perforations and upwardly into the main plenum of the well point system. It should be noted that in this way there has been little need for hand labor and, when the well points are removed after they are no longer needed, the pre-formed well point can be reused at a later site. With this method and apparatus, three men can insert 200 twenty-foot well points in a day. No high pressure water supply is necessary at all.

Although this invention will be described with respect to its preferred embodiments, it should be understood that many variations and modifications will be obvious to those skilled in the art, and it is preferred, therefore, that the scope of the invention be limited, not by the specific disclosure herein but only by the appended claims.

DETAILED DESCRIPTION OF THE DRAWINGS

Figure 1:
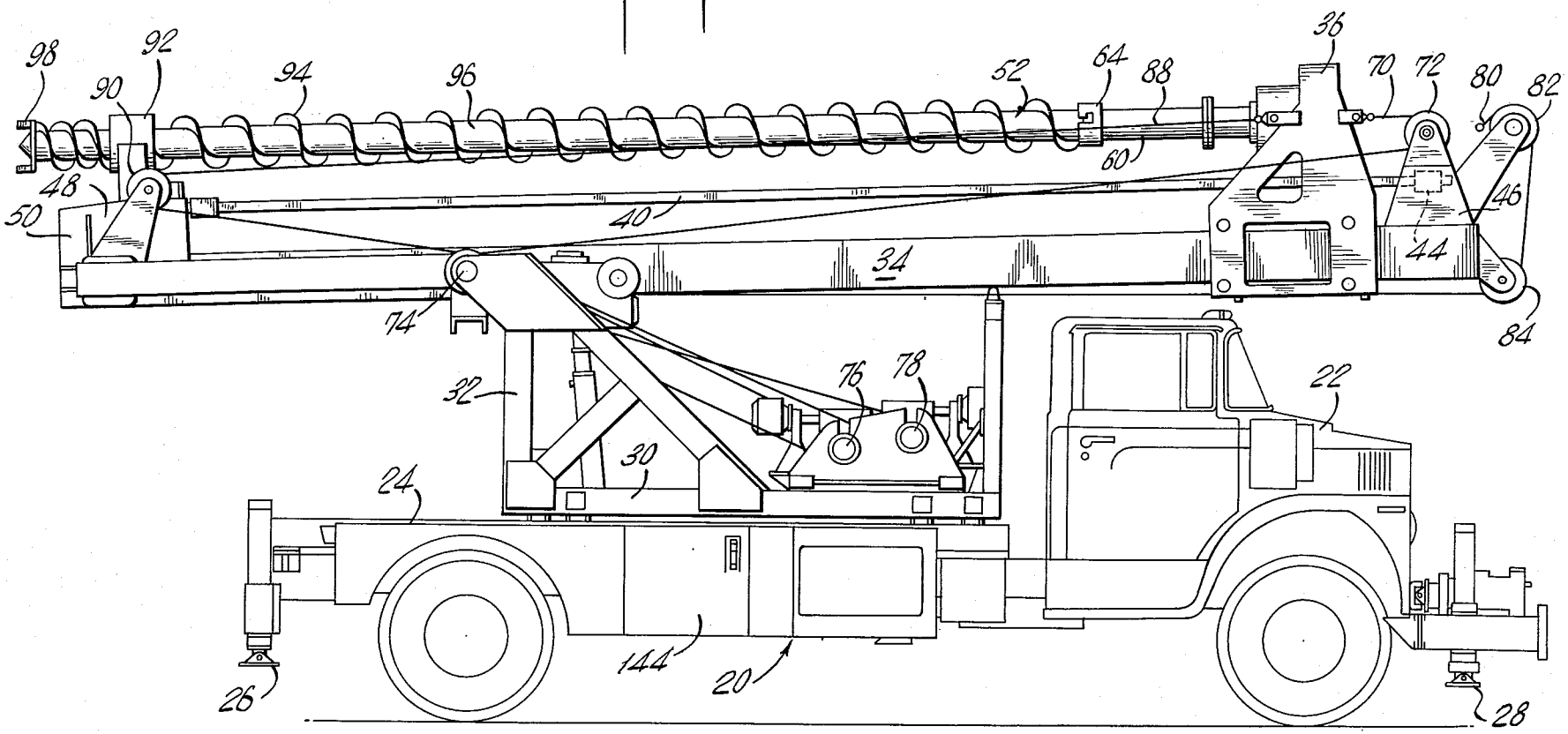
FIG. 1 is a side view of a mobile vehicle supporting the portable well point inserting auger of the present invention.
Figures 4, 5, 6, 7, 8, 9:
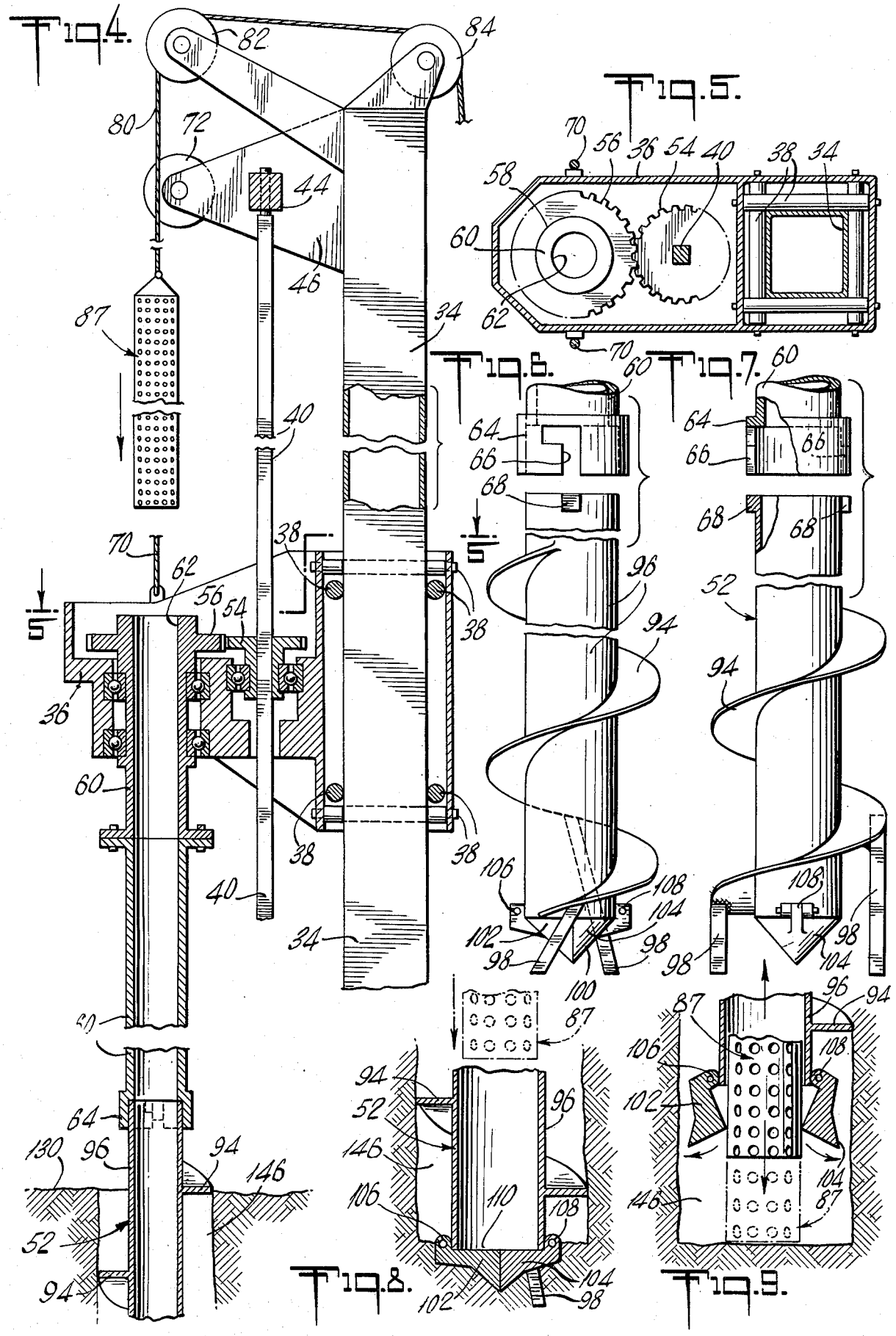
FIG. 4 is a cross-sectional view of the well point auger after it has been drilled into the ground with the pre-formed well point in position for insertion into the hollow auger.
FIG. 5 is a cross-sectional view of the main drive system of the well point auger taken along lines 5—5 of FIG. 4.
FIG. 6 is an enlarged view of the hollow well point auger decoupled from its drive.
FIG. 7 is a right side view of the auger of FIG. 6.
FIG. 8 is a cross-sectional view of the hollow auger after it has reached the bottom of a hole with the pre-formed well point thereabove.
FIG. 9 is a cross-sectional view similar to FIG. 8 in which the pre-formed well point has been dropped to open the bottom of the hollow auger.

In FIG. 1, there is shown the well point inserting apparatus of the present invention generally designated by the numeral 20. The apparatus includes a flatbed truck 22 having a flatbed 24. The truck can be stabilized when in use by reason of hydraulic front and rear jacks 26 and 28, respectively. A carriage 30 mounted on the flatbed 24 and is slidably movable by motor means not shown. In FIG. 1, the carriage 30 is shown in the retracted position when the truck 22 is ready for transportation of the well point installing apparatus and, in FIG. 2, the carriage 30 is shown slidable to the rearmost position on the flatbed 24 ready for operation. In the operating position, it should be noted that the jacks 26 and 28 have been extended so as to stabilize the vehicle 22. The carriage 30 has integrally connected therewith a triangular truss 32 to which is pivotally secured the main beam 34 of the apparatus. The main beam 34 has slidably secured thereon an auger drive carriage 36. The auger drive carriage 36 is slidably secured on the beam 34 by reason of rollers 38. A Kelly bar 40 is mounted between bearings 42 and 44, mounted on supports 46 and 48 supported by the beam 34. The Kelly bar 40 is mounted parallel to the beam 34. The support 48 supports a hydraulic drive motor 50 which drives Kelly bar 40 through the bearing 42. The hydraulic drive motor 50 is intended to ultimately drive the hollow auger 52 mounted parallel to the Kelly bar 40 and supported and driven at its upper end from carriage 36. Carriage 36, as best shown in FIGS. 4 and 5, includes a spur gear 54 driven directly by Kelly bar 40 which passes through the center thereof. The spur gear 54 meshes with auger drive gear 56 which is annular in shape and has a circular opening 58 which is integral with a hollow tube 60. As best shown in FIGS. 6 and 7, hollow tube 60 has the same inner diameter 62 as the auger 52. The drive gear 56 and its integral tube 60 have a coupling member 64 at the bottom thereof which include an L-shaped detent 66 adapted to receive lugs 68 on the auger 52. The lugs 68, when inserted into the L-shaped recesses 66, lock the auger 52 into drive relationship with the gear 56. The carriage 36 is raised by way of cables 70 connected around winches 72 and 74 to separate hydraulic drive motors 76 and 78 for raising the carriage. The separate cable 80 mounted around winches 82 and 84 is controlled by hydraulic motor 86 for lifting a well point into position above the upper opening in tube 60 and thence dropping the well point 87 into position as best shown in FIG. 4. The hydraulic drive motors 76 and 78 are capable of lifting the auger carriage 36 by reason of the cable 70 or, alternatively, lowering the auger carriage by reason of cables 88 which pass around winches 90 and thence around winches 92 to drive motors 76 and 78. Cables 88 and 70 are merely the lowering and raising respective ends of a single pair of cables driven by hydraulic motors 76 and 78.

The support 50 has a cylindrical guide 92 mounted on one end thereof for guiding the auger 52. The auger 52 has a spiral channel formed about the outer surface thereof by a spiral flute 94 integral with the outer surface of the hollow tube 96. The hollow tube 94 has an inner diameter slightly greater than the outer diameter of the pre-packed well point 87. The hollow auger 52 has teeth 98 integral with the spiral fluting 94 at the bottom thereof for cutting into the ground as the auger is rotated about its axis. A separable bit or tip 100 is hingably mounted at the bottom of the tube 96. Separable bit or tip 100 includes two semi-conical parts 102 and 104 each pivotally mounted to a pivot 106 and 108 integrally supported on the outer surface of the tube 196. As can be seen, the semi-conical tip halves 102 and 104 will open by gravity or by pressure on the inner surface 110 thereof allowing the well point 87 to pass through the tube 96 and out the bottom thereof. It should further be noted that the semi-conical tips 104, when open in the position shown in FIG. 9, do not extend beyond the outer diameter of the spiral fluting 94.

Figures 10, 11, 12:
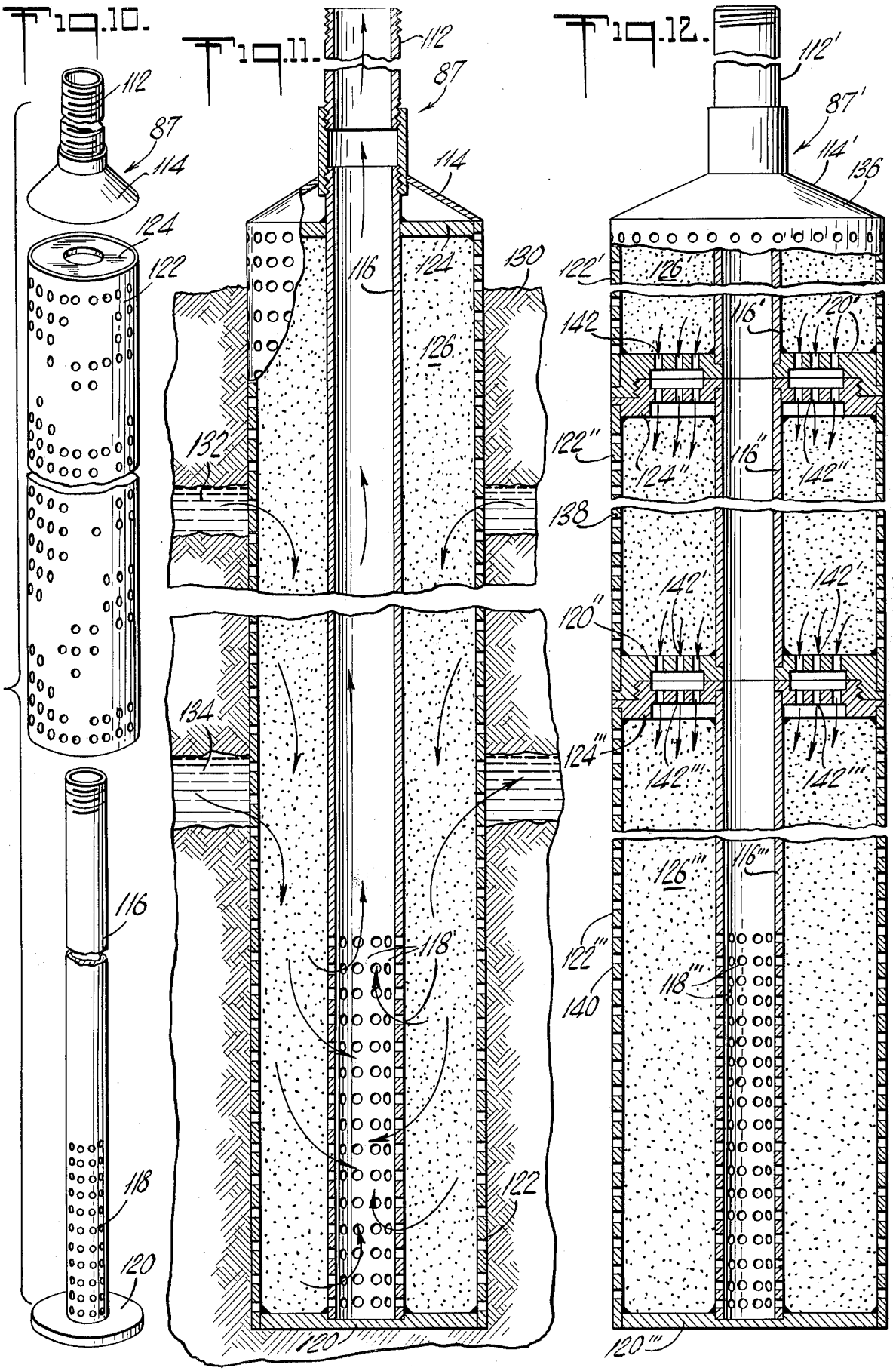
FIG. 10 is an exploded view of the pre-formed well point.
FIG. 11 is a cross-sectional view of the well point after positioning in the ground.
FIG. 12 is a cross-sectional view of another embodiment of the present invention in which the pre-formed well point is formed in sections.

The pre-packed well point 87 is shown in an exploded view in FIG. 10. The well point 87 includes a coupling tube 112 secured to a top closure member 114. Also secured to the top closure member 114 is an inner tube 116. The closure member, the coupling tube 112, and the inner tube 116 are imperforate, except that inner tube 116 has perforations 118 at the bottom thereof. In actual working embodiments, the perforations 118 extend only 12 inches from the bottom of the tube 116. Secured to the bottom of the tube 116 is a flat circular closure plate 120 which closes off the bottom of tube 116, and, further, has secured at its outer edge the bottom edge of screen tube 122. Screen tube 122 is secured at its top edge to closure member 114 and, further, to the top annular imperforate plate 124. The screen tube 122 has perforations in the outer surface thereof which are equal to or of a smaller diameter than the diameter of gravel 126 which is packed into the annular space between tube 116 and screen 122 and defined by end walls 120 and 124. The gravel 126 is also too large to pass through the perforations 118 in the bottom end of tube 116. When the well point 87 is placed in ground 130 as shown in FIG. 11, the vacuum is drawn through the coupling end 112. This causes water in the water tables 132 and 134 to be drawn through the perforations in screen 122 through the gravel 126 downwardly until the water is pulled through perforations 118 into the center of inner tube 116. Thence, the water is withdrawn upwardly through the coupling member 112. It can be seen that the water is drawn downwardly through the gravel 126 and, because it is pre-packed, there can be no problems because of bridging or gaps in the gravel.

In FIG. 12, there is shown an alternate embodiment of a well point built in accordance with the principles of the present invention. It may be desirable to have sectional pre-formed well points which can be joined together to form well points of predetermined lengths. That is, in FIG. 12 there is shown a well point 87′ formed of three separate sections, 136, 138 and 140. It will be understood, as further discussed below, that additional sections 138 could be interposed between sections 136 and 140 to increase the length of the well point. For example, if section 138 is four feet in length, additional four foot sections could be added to increase the overall length of the well point. In FIG. 12, there is shown a coupling tube 112′ connected to a top member 114′ forming a portion of section 136. Section 136 has an inner tube 116′ and an outer screen 122′ with a space between the tubes filled with gravel 126′. The bottom plate 120', however, is annular leaving an opening for tube 116' and further having openings 142 and being screw threadably engageable into the top plate 124'' of section 138. Top plate 124'' also has openings 142' communicating with the opening 142 so as to allow the flow of water from gravel 126' directly into the gravel 126'' positioned between the inner tube 116'' and the outer screen tube 122'' of section 138. The bottom of section 138 is closed by bottom closure member 120'' having openings 142' therein and being screw threadably engageable to the top cover plate 124''' of section 140.

Figures 2, 3, 13, 14:
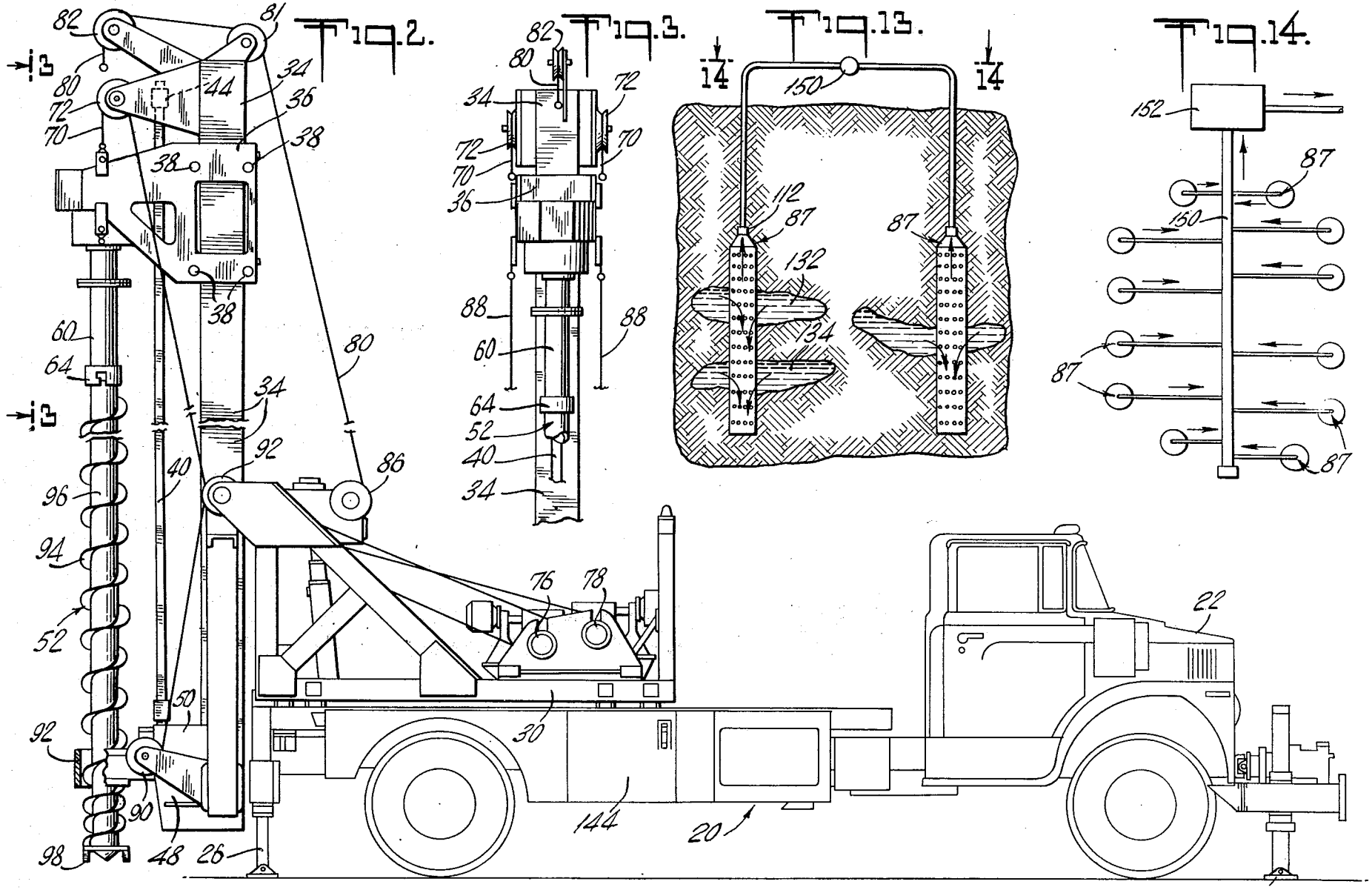
FIG. 2 is a side view of the vehicle of FIG. 1 wherein the well point auger has been placed in position for drilling.
FIG. 3 is a partial elevational view taken from arrows 303 of FIG. 2.
FIG. 13 is a cross-sectional view of a pair of well points connected up to a vacuum system.
FIG. 14 is a top plan view of the well points of FIG. 13 in a complete system of well points to draw down the water table of an area.

The top cover 124''' of section 140 also is annular and connects the top edges of inner tube 116''' and outer screen tube 122''' so that tubes 116', 116'', 116''' are all axially aligned and provide, when coupled, the same path as tube 116 in pre-form well point 87. Top cover member 124''' has passageways 142''' formed therein to complete the path from passageways 142'. A bottom cover plate 120''' covers the entire bottom of section 140, including the bottom edge of tube 116'''. Gravel 126''' is placed within the annular space formed by tubes 116''' and screen tube 122'''. The inner tube 116''' has at its bottom perforations 118''' extending upwardly from the bottom of cover plate 120''' a length approximately twelve inches as was the case in pre-formed well point 87. Thus, it can be seen that additional sections 138 can be inserted into place and coupled with the bottom section 140 and the top section 136 being required to form a composite well point whose length is determined by the number of sections 138 added. It may even be possible to get a very short well point wherein the section 138 is removed. Thus, it would be possible to stock well points with the sections 136, 138 and 140 without regard to the depth to which the particular well point operation is directed. It is further understood that the vehicle 22 can have a compartment 144 for receiving stock preformed well points as it moves around the job. As best shown in FIG. 13, extension tubes can be coupled to the well point 87 when the pre-packed well point is only needed at the bottom of the hole.

In operation, as best shown in FIGS. 4, 8 and 9, the auger 52 is raised to its uppermost position by cable 70 and then rotated by Kelly bar 40 driven by its hydraulic motor 50 to gears 54 and 56. As the auger rotates, the carriage 36 is pulled downwardly by cables 88 drilling a hole 146 in the ground 130. The spiral channel formed by the spiral flutes 94 pulls the earth upwardly and the teeth 98 dig into the ground. The cup-shaped bit or tip 100 remains in the closed position as it is forced upwardly into the position shown in FIG. 8 by the ground which is being drilled. After the auger 52 has reached its lowermost position, the hydraulic motor 50 is rotated and the cable 70 pulls upwardly on the auger to lift it from the hole approximately twelve inches. As shown in FIG. 9, this causes the semi-conical tip portions 102 and 104 to rotate about their respective axes 106 and 108. The pre-packed well point 87 is hoisted into position utilizing cable 80 and its associated winches 82 and 84 and hydraulic motor 86 and thence dropped into the tube 60 through which it passes as the inner diameter 62 of tube 60 is slightly greater than the outer diameter of the pre-packed well point 87. Similarly, the inner diameter of the tube 96 is also slightly greater than the outer diameter of the well point 87. When the well point 87 has dropped downwardly, it finally passes by the conical portions 102 and 104 forcing them outwardly but not into the side walls of the hole 146. When the well point finally rests on the bottom of the hole 146, the auger 52 is thence rotated and pulled upwardly out of the hole 146. This causes dirt packed in the spiral grooves and on the side walls of the hole to move downwardly about the well point holding it in place. Once the auger is removed from the ground, the well point coupling member 112 is coupled to a vacuum 150 in the manner shown in FIGS. 13 and 14. After a number of these well points are placed, and coupled, a suitable pump 152 is used to draw the water from the water tables 132 and 134 out through the inner tubes 116 in the manner discussed previously with respect to FIG. 11. The drawing of the water also serves to pull the dirt from around the hole 146 into compaction against the side surfaces of the screen 122. After the well points are no longer needed, they can be drawn from the ground by merely coupling the member 112 to the hoist 80 and pulling the unit intact out of the ground. This enables the pre-formed well point to be reused at a new location and avoids the need for loss of valuable gravel.

It can be seen that this operation can be accomplished with a minimum of labor and, in fact, only one person is necessary to operate the entire well point drilling rig 20.

Although this invention has been described with respect to its preferred embodiments, it should be understood that many variations and modifications will now be obvious to those skilled in the art, and it is preferred, therefore, that the scope of the invention be limited, not by the specific disclosure herein, but only by the appended claims.

What is claimed is:

1. A method of lowering ground water including:

a. providing a hollow auger having an openable tip, b. drilling a hole in the ground using said auger, c. lifting the auger slightly from the bottom of the formed hole in the ground after reaching a predetermined depth, d. inserting a prepacked well point downwardly through the hollow auger and the openable tip, said prepacked well point including a hollow tube having perforations only at a closed bottom end thereof, a filter medium around said tube and a screen member around said filter medium, e. lifting the hollow auger out of the hole leaving the prepacked well point in the ground, f. coupling the hollow tube to a vacuum source for removing water from the ground after the auger has been removed, whereby the vacuum source causes the water in the ground to pass through the said screen member, flow through the filter medium and enter the said hollow tube.

2. The method of lowering ground water of claim 1 including after the completion of step (f) of removing the prepacked well point from the ground as an integral unit so that said prepacked well point can be reused in performing steps (a) through (f).

* * * * *